US009242485B2

(12) United States Patent
Wada

(10) Patent No.: US 9,242,485 B2
(45) Date of Patent: Jan. 26, 2016

(54) RECORDING DEVICE

(71) Applicant: SEIKO EPSON CORPORATION, Tokyo (JP)

(72) Inventor: Naoyuki Wada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/470,408

(22) Filed: Aug. 27, 2014

(65) Prior Publication Data

US 2015/0062229 A1 Mar. 5, 2015

(30) Foreign Application Priority Data

Sep. 5, 2013 (JP) ..... 2013-183800

(51) Int. Cl.
*B41J 2/01* (2006.01)
*B41J 11/64* (2006.01)
*B41J 15/04* (2006.01)

(52) U.S. Cl.
CPC ..... *B41J 11/64* (2013.01); *B41J 15/042* (2013.01)

(58) Field of Classification Search
CPC ..... B41J 11/42; B41J 11/007
USPC ..... 347/16, 104
See application file for complete search history.

(56) References Cited

U.S. PATENT DOCUMENTS

| | | | | | |
|---|---|---|---|---|---|
| 5,237,644 | A * | 8/1993 | Shinohara | 358/1.12 |
| 5,940,659 | A * | 8/1999 | Rieck | 399/124 |
| 5,967,675 | A * | 10/1999 | Hastings et al. | 400/61 |
| 2002/0186399 | A1 * | 12/2002 | Nakajima | B41J 11/006 358/1.14 |
| 2003/0161656 | A1 * | 8/2003 | Miura et al. | 399/116 |
| 2008/0074697 | A1 * | 3/2008 | Sawada et al. | 358/1.15 |
| 2014/0002569 | A1 * | 1/2014 | Yuno | B41J 3/4075 347/218 |

FOREIGN PATENT DOCUMENTS

| | | | | |
|---|---|---|---|---|
| CN | WO 2010099666 | A1 * | 9/2010 | G03G 15/553 |
| JP | 63127937 | A * | 5/1988 | B65H 3/44 |
| JP | 09249339 | A * | 9/1997 | |
| JP | 2007-050667 | | 3/2007 | |

* cited by examiner

*Primary Examiner* — Julian Huffman
*Assistant Examiner* — Sharon A Polk
(74) *Attorney, Agent, or Firm* — Workman Nydegger

(57) ABSTRACT

A recording device includes: a housing having an opening; an opening/closing cover that can be disposed in a closed position where the opening is covered, and an open position where the opening is exposed; a medium holder that holds a medium; a recorder that performs recording on a medium; and a transport mechanism that transports the medium from the medium holder toward the recorder along a transport path, in which the medium holder is provided with, a feed port for the medium, connected to the transport path and an alarm unit that warns that the medium is disposed at a position where the medium can be transported by the transport mechanism, and when the opening/closing cover is disposed in the open position, the feed port and the alarm unit can be visually checked.

5 Claims, 3 Drawing Sheets

RECORDING DEVICE

BACKGROUND

1. Technical Field

The present invention relates to a recording device, such as a printer.

2. Related Art

As an example of a recording device, there is a printer that holds roll paper which is long paper wrapped in a cylindrical shape and that performs printing on the roll paper. Such printers may be provided with a lamp on the exterior of a roll paper cover rotatably installed on a main unit. The lamp warns when there is no roll paper (for example, JP-A-2007-50667).

In the above-described printer, in general, after opening the roll paper cover and loading roll paper into the interior of the main unit, by manually feeding the end of the unrolled roll paper into the transport path, the roll paper is disposed at a position where automatic transport is possible. For this reason, the above-described lamp is lit or unlit when the end of the roll paper has been fed up to the position where automatic transport is possible, and the presence of roll paper has been detected.

However, the above-described lamp is disposed on the exterior of the roll paper cover. Accordingly, after the roll paper is loaded and fed and the roll paper cover is closed once, whether the roll paper is fed up to the target position and the lamp is lit is visually checked. Thus, if the roll paper is not fed up to the target position, the roll paper cover is opened, the feeding of the roll paper is reattempted, and the roll paper cover is again closed so as to check the lamp. There is a need to repeat the loading and feeding, and the feeding completion checking, and the problem is that time and effort are required for these tasks.

This problem is not limited to printers that eject ink on roll paper, and is widely shared among recording devices provided with an alarm unit relating to the presence of a medium.

SUMMARY

An advantage of some aspects of the invention is to provide a recording device in which, while positioning a medium in the transport path, it is possible to visually check whether the medium is disposed at a position where the medium is automatically transported.

A recording device according to an aspect of the invention includes a housing having an opening; an opening/closing cover that is able to be disposed in a closed position where the opening is covered and an open position where the opening is exposed; a medium holder that holds a medium; a recorder that performs recording on the medium; and a transport mechanism that transports the medium along a transport path from the medium holder toward the recorder, in which the medium holder is provided with a feed port, for the medium, connected to the transport path and an alarm unit that warns that the medium is disposed at a position where the medium is able to be transported by the transport mechanism, and when the opening/closing cover is disposed in the open position, the feed port and the alarm unit are visually checked.

According to the above-described configuration, the alarm unit that is provided on the medium holder is in a state where the alarm unit can be visually checked together with the feed port through the opening, when the opening/closing cover is disposed in the open position. Accordingly, while feeding the end of the medium into the feed port, it is possible to visually check the alarm unit. Hence, while disposing the medium on the transport path, it is possible to visually check whether or not the medium is disposed at a position where automatic transport is possible.

In the above-described recording device, the opening/closing cover can be detachable with respect to the housing, and the alarm unit issues a warning in a state where the opening/closing cover is removed from the housing.

According to this configuration, when the medium is fed in a state where the opening/closing cover has been removed from the housing, as well, when the medium is disposed at a position where automatic transport is possible, the alarm unit issues a warning, and thus it is possible to easily perform a visual check of whether or not the medium is disposed at a position where automatic transport is possible.

In the above-described recording device, the transport mechanism has a transport roller that transports the medium toward the recorder, a detector that detects the medium being provided on the transport path downstream of the transport roller in the transport direction, and the alarm unit is an alarm light that is lit when the detector detects the medium, and when the opening/closing cover is in the closed position, it is possible to visually check the lit status of the alarm light.

According to this configuration, the alarm light is lit when the detector detects the medium, and thus, when the detector detects the medium fed into the feed port and the alarm light changes from an unlit state to a lit state, it is possible to determine that the medium has been disposed at a position where automatic transport is possible. On the other hand, when the medium held by the medium holder runs out, and the detector no longer detects the medium, the alarm light changes from a lit state to an unlit state, and thus it is possible to determine that the medium is no longer at a position where automatic transport is possible. Further, when the medium held by the medium holder runs out, even if the opening/closing cover is in the closed position, it is possible to visually check that the alarm light has changed from a lit state to an unlit state. Hence, without exposing the opening, it is possible to visually check that the medium held by the medium holder has run out.

In the above-described recording device, the medium holder is retractable from the housing via the opening, and is accommodated within the housing when the recorder performs recording, while an operating section for operating the recorder is provided on the exterior of the housing.

According to this configuration, the operation of the recorder is performed through the operating section disposed on the exterior of the housing; on the other hand, the operation to position the medium that has been unrolled from the roll can be performed while disposing the opening/closing cover in the open position, and visually checking the alarm unit. That is, by equipping the alarm unit at a position that is different from that of the operating section, it is possible to dispose the operating section and the alarm unit at the most easily seen positions in accordance with the nature of the operation.

In the above-described recording device, the opening/closing cover has optical transparency.

According to this configuration, since the opening/closing cover has optical transparency, it is possible to visually check the display status of the alarm unit, even when the opening/closing cover is disposed in a closed position. For example, if the alarm unit is an alarm light, it is possible to visually check whether the alarm light is lit or not.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the recording device according to the invention will be described with reference to the accompanying drawings. The recording device is, for example, a printer that performs recording (printing) by ejecting ink, which is an example of a liquid, on a medium.

Figure 1:
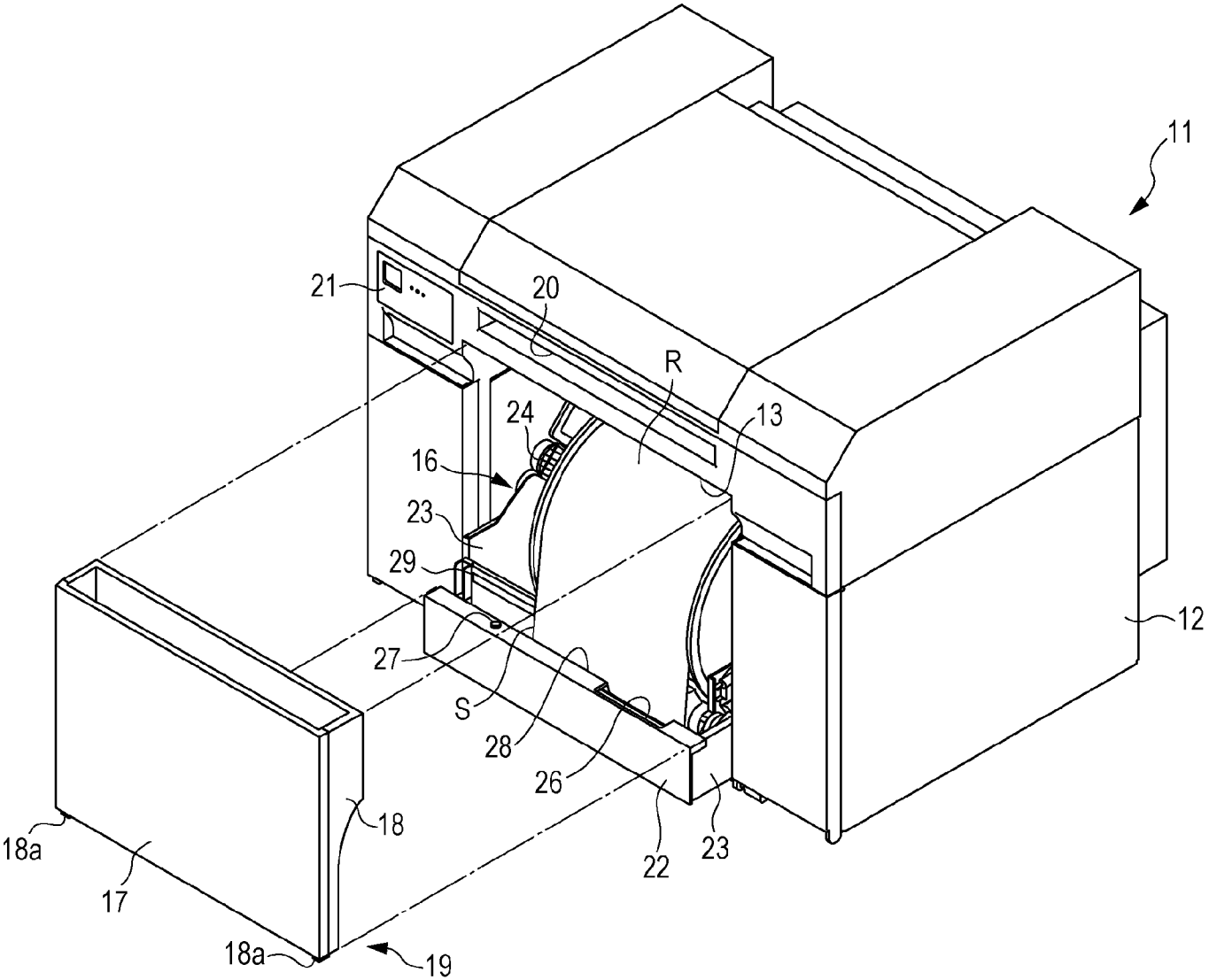
FIG. 1 is a perspective view illustrating a recording device according to an embodiment of the invention, in which an opening/closing cover is in an open state.

As illustrated in FIG. 1, a recording device 11 of the present embodiment is provided with a housing 12. An opening 13 is formed on the front side of the housing 12. Within the housing 12, a medium holder 16 is accommodated in a state such that the medium holder 16 is retractable through the opening 13. The medium holder 16 holds, in a rotatable state, a roll R, in which a medium S has been wrapped in a cylindrical shape.

An opening/closing cover 17, which can be disposed in a closed position (the position illustrated in FIG. 2), where the opening 13 is covered, and an open position (the position illustrated in FIG. 1), where the opening 13 is exposed, is installed on the housing 12. The opening/closing cover 17 has optical transparency, and is formed from a transparent or translucent material that transmits light. When disposed in the closed position, the opening/closing cover 17 constitutes a part of the exterior of the recording device 11.

A container formation member 18, which is disposed in the interior of the housing 12 when it is disposed in a closed position, is installed on the opening/closing cover 17. According to the present embodiment, the container formation member 18 is formed of a material that does not transmit light, but the material of the container formation member 18 is not limited to this. Moreover, the opening/closing cover 17 and the container formation member 18 form a container 19. Furthermore, in the container formation member 18, a pair of supporting protrusions 18*a*, serving as leg portions, extend from portions that constitute the bottom of the container 19.

An outlet 20 is formed on the front surface of the housing 12, at a position vertically upward of the opening 13. An operating section 21, for performing the operations of the recording device 11, is also provided on the front surface of the housing 12. Moreover, it is possible to dispose a display for displaying menu screens or the like, and operating buttons or the like, in the operating section 21. The display may be, for example, an LCD display, and a plurality of members that are LED lamps or the like, used for display, may be disposed. Moreover, operation is easier if the display and operating buttons or the like of the operating section 21 are disposed within a range in which even without moving the line of sight, they fall entirely within the field of view.

The medium holder 16 is provided with a front plate 22, which is a part of the exterior of the recording device 11 when accommodated in the housing 12, and a pair of support walls 23, which support the roll R. The medium holder 16 is also provided with a handle 26, recessed into the rear surface of the front plate 22, an alarm unit 27, positioned on the top surface of the front plate 22, and a feed port 28, for feeding the leading edge of the medium S that has been unrolled from the roll R.

The feed port 28 is formed of the front plate 22, and a feed port formation member 29, which is positioned in the rear of the front plate 22. Moreover, the handle 26, the alarm unit 27, and the feed port 28 are in a state where visual checking is possible through the opening 13, when the opening/closing cover 17 is disposed in an open position.

Figure 2:
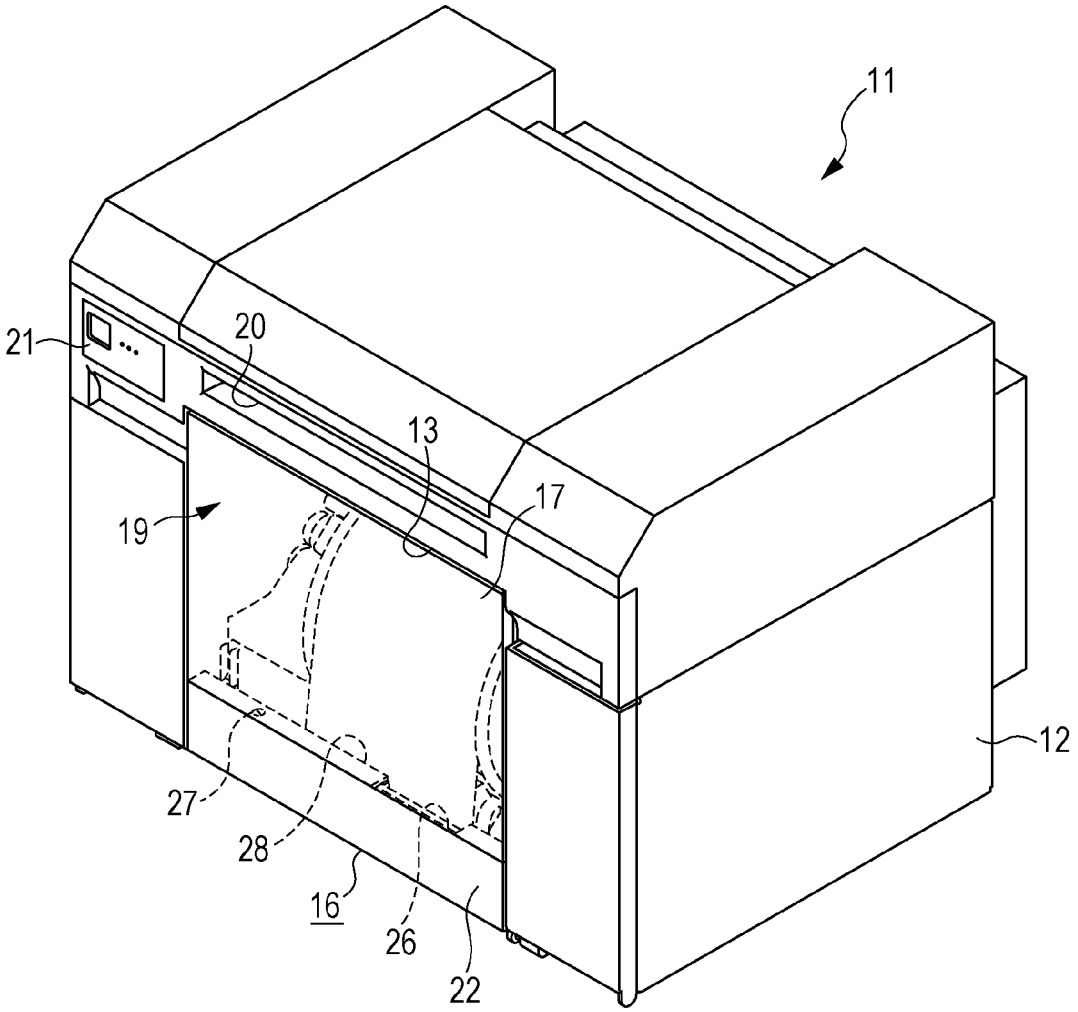
FIG. 2 is a perspective view illustrating the recording device according to the embodiment, in which the opening/closing cover is in a closed state.

As illustrated in FIG. 2, when the medium holder 16 is accommodated within the housing 12, and the opening/closing cover 17 is disposed in a closed position, the medium holder 16 is in a state in which the portion excluding the front plate 22 is covered by the container 19.

Figure 3:
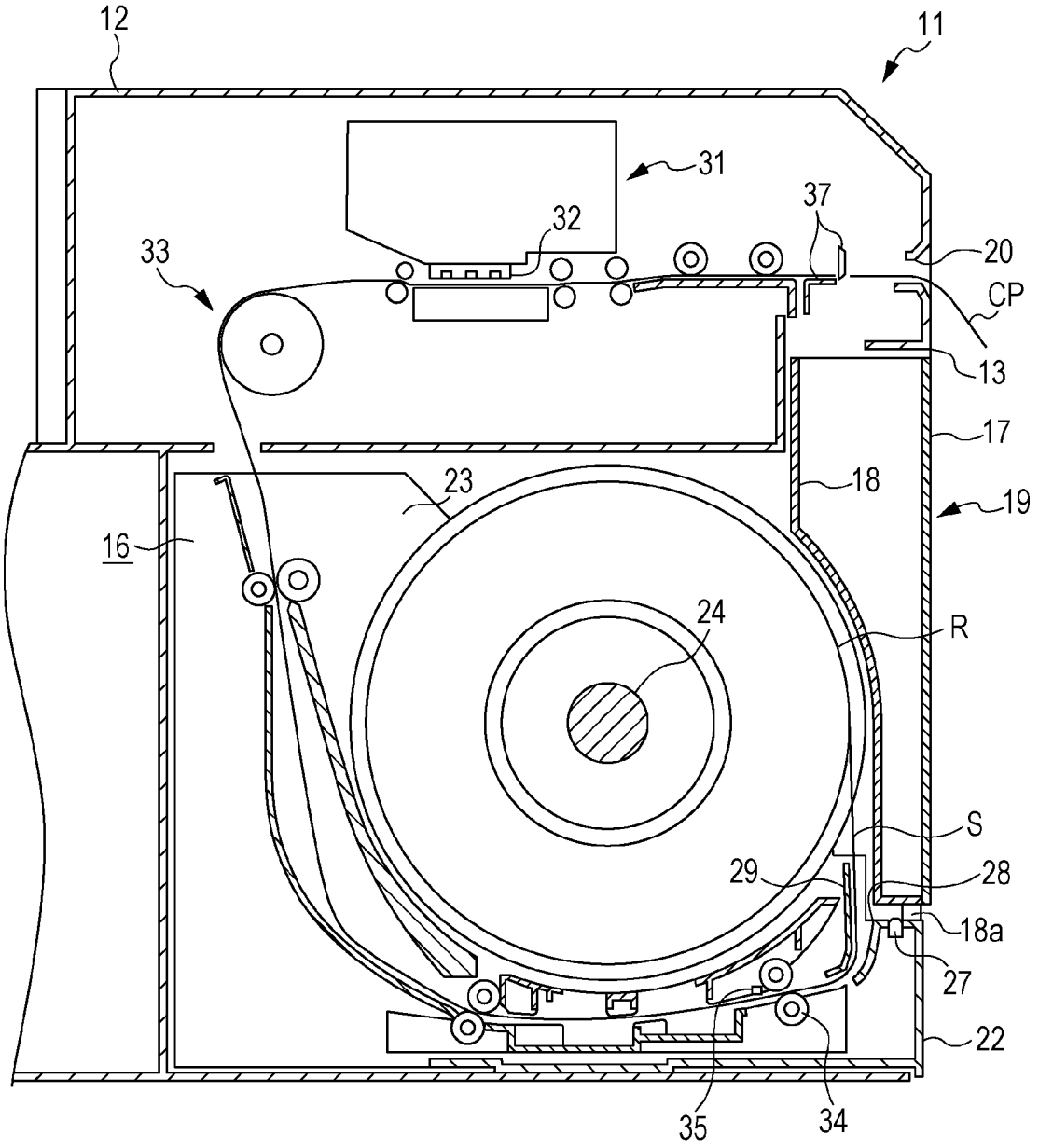
FIG. 3 is a cross-sectional view of the recording device according to the embodiment.

As illustrated in FIG. 3, within the housing 12, a recorder 31, which performs recording on the medium S, unrolled from the roll R, is accommodated in the upward direction in the space used for the medium holder 16. The recorder 31 is provided with a liquid ejecting head 32, which is able to eject ink that is an example of a recording material. Moreover, between the recorder 31 and the outlet 20, a cutter 37 for cutting the medium S is provided.

The recording device 11 includes a transport mechanism 33, which transports the medium S along a transport path from the medium holder 16 toward the recorder 31. On the medium holder 16, a transport path toward the recorder 31 is formed, and together with this, a plurality of transport rollers, with which the transport mechanism 33 is configured, are disposed along the transport path.

The feed port 28 is connected to the transport path that is formed in the medium holder 16. Moreover, the transport path for the medium S in the medium holder 16 extends downward from the feed port 28. Accordingly, when the medium S is fed into the feed port 28, the leading edge of medium S is inserted in a downward direction.

In the transport path formed in the medium holder 16, transport rollers 34, with which transport mechanism 33 is configured, are provided at a position close to the feed port 28. The transport rollers 34 transport the medium S in the transport direction toward the recorder 31, when rotating in the counter-clockwise direction in FIG. 3, by means of the drive power from a drive source, not shown. Moreover, in the transport path, downstream of the transport rollers 34 in the transport direction, a detector 35 for detecting the media S is provided.

The detector 35 is an optical sensor including an emitter that has, for example, a light emitting diode, and an optical receptor that has, for example, a photodiode. By detecting the leading edge and trailing edge of the medium S from the changes in the state of receiving light, which is caused by the passage of the medium S, the detector 35 detects the presence of the medium S in the transport path.

The alarm unit 27 according to the present embodiment is an alarm light that changes from the unlit state to the lit state when the detector 35 detects the leading edge of the medium S, and changes from the lit state to the unlit state when the detector 35 detects the rear edge of the medium. The alarm light can be provided with, for example, a light emitting diode, and be configured to emit light.

When the leading edge of the medium S, which is fed from the feed port 28, is positioned downstream of the transport rollers 34, automatic transport by the transport mechanism 33 becomes possible. Then, when the detector 35, which is provided downstream of the transport rollers 34 in the transport direction, detects the medium S, the alarm light is lit and emits light. Hence, when the detector 35 detects the leading edge of the medium S, the alarm unit 27 is lit and warns that the medium S is disposed in a position at which the medium S can be transported by the transport rollers 34. The alarm unit 27 performs the warning even if the opening/closing cover 17 has been removed from the housing 12.

When the opening/closing cover 17 is disposed in a closed position, the bottom of the container 19, which is configured from the container formation member 18, is disposed above the alarm unit 27. At this time, the support protrusions 18*a*, which protrude from the container formation member 18, contact with the top surface of the front plate 22, and between the alarm unit 27 and the bottom of the container 19, a gap is formed. In addition, the opening/closing cover 17 allows light to be transmitted, and therefore, the lit state of the alarm unit 27 can be visually checked through the gap between the alarm unit 27 and the container 19, even when the opening/closing cover 17 is in the closed position.

Next, the usage of the recording device 11, configured as above, is described. If the roll R is set in the medium holder 16, as illustrated in FIG. 1, after removing the opening/closing cover 17 from the housing 12, the handle 26 is gripped and the medium holder 16 is pulled out from the housing 12 toward the front. Then, after loading a rotating shaft 24 of the roll R in the support walls 23, the leading edge of the medium S, which is unrolled from the roll R is fed into the feed port 28.

At this time, the transport path of the medium S, which is connected to the feed port 28, extends downward, so that it is not possible to visually check directly whether or not the leading edge of the medium S has reached a position in contact with the transport rollers 34.

At this point, in the present embodiment, the alarm unit 27 changes from the unlit state to the lit state when the detector 35 detects the leading edge of the medium S. The alarm unit 27 is disposed in the vicinity of the feed port 28, so that it is possible to perform a simultaneous visual check of the alarm unit 27 and the feed port 28. Hence, by performing feeding of the medium S while viewing the alarm unit 27, it is possible to easily confirm that the medium S has been appropriately fed up to a position where automatic transport is possible.

Additionally, when the medium S is fed into the feed port 28, it is preferable that, without changing the line of sight, the alarm unit 27 and the feed port 28 be disposed at positions that fall within the same field of view. In this case, it is possible to feed the medium S into the feed port 28 while checking the warning status of the alarm unit 27, and the feeding of the medium S is easily performed.

It is preferable that the alarm unit 27 be separated from the display of the operating section 21, and disposed at a position that does not fall within the same field of view. In this case, because the display of the operating section 21 and the alarm unit 27 are separated from each other and do not fall within the same field of view, there is no confusion about the state of the display when performing operation. In addition, because the display of the operating section 21 and the alarm unit 27 are separated from each other, it is easy to distinguish the lit state of the alarm unit 27 from the state of the display of the operating section 21 and visually check the state of the alarm unit 27. Therefore, even from some distance away from the recording device 11, it is possible to easily check whether the medium S is present.

When the alarm unit 27 changes from the unlit state to the lit state, the medium holder 16 is accommodated within the housing 12. As illustrated in FIG. 2, the container 19 is installed in the housing 12 such that the opening 13 is covered.

After the detector 35 detects the leading edge of the medium S, when the accommodation of the medium holder 16 and the installation of the container 19 are complete, the transport rollers 34 of the transport mechanism 33 are driven, and thus, while the medium S is being unrolled from the roll R, paper feed is performed, whereby the leading edge of the medium S is transported up to the vicinity of the recorder 31. This paper feed may be performed automatically, and it may also be performed by an operation via the operating section 21.

After performing the paper feed, when instructions to perform printing are sent to the recorder 31 via an operation in the operating section 21, which is provided on the exterior of the housing 12, recording (printing) on the medium S is performed by ejecting ink from the liquid ejecting head 32 toward the medium S, which is transported by the transport mechanism 33. That is, when the recorder 31 performs recording, the medium holder 16 is accommodated in the housing 12.

By cutting the portion on which recording has been performed, for each unit length, with the cutter 37 from the medium S, cut paper CP is obtained. Cut paper CP on which recording has been complete is ejected to the outside of the housing 12 through the outlet 20. The cutter 37 cuts out the margin between the trailing edge of cut paper CP, which was cut first, and the leading edge of cut paper CP, which was cut next. The cut pieces of the medium S that are cut out fall downward and are accommodated in the container 19.

When the medium S is completely unrolled accompanying the performance of recording, and the detector 35 detects the trailing edge of the medium S, the alarm unit 27 changes from the lit state to the unlit state. At this time, the opening 13 has been covered by the container 19, but the opening/closing cover 17 allows light to be transmitted, and therefore, even if the opening/closing cover 17 still covers the opening 13, the fact that the alarm unit 27 changes from a lit state to an unlit state can be visually checked. Hence, if the alarm unit 27 changes to the unlit state, as mentioned above, the opening/closing cover 17 is pulled out from the housing 12, and a new roll R is set in the medium holder 16.

According to the above-described embodiment, it is possible to obtain the effects below.

(1) When the opening/closing cover 17 is disposed in an open position, the alarm unit 27, which is provided on the medium holder 16, can be visually checked, together with the feed port 28, through the opening 13, so it is possible to visually check the alarm unit 27 while performing feeding of the leading edge of the medium S into the feed port 28. Hence, in a state of performing disposing of the medium S in the transport path, it is possible to visually check whether or not the medium S is disposed in a position where automatic transport is possible.

(2) When the medium S is fed in the state in which the opening/closing cover 17 has been removed from the housing 12, the alarm unit 27 also performs a warning when the medium S is disposed in a position where automatic transport is possible, so it is possible to easily perform a visual check of whether or not the medium S is disposed in a position where automatic transport is possible.

(3) When the detector 35 detects the medium S, the alarm light is lit, and thus, when the detector 35 detects the leading edge of the medium S, which has been fed into the feed port 28, and the alarm light changes from an unlit state to a lit state, it is possible to determine that the medium S has been disposed in a position where automatic transport is possible. On the other hand, when the medium S, which is held in the medium holder 16, runs out, and the detector 35 no longer detects the medium S, the alarm light changes from a lit state to an unlit state, and thus, it is possible to determine that the medium S is no longer disposed in a position where automatic transport is possible. When the medium S, which is held in the medium holder 16, runs out, even if the opening/closing cover 17 is in a closed position, it is possible to visually check that the alarm light has changed from a lit state to an unlit state.

Hence, without exposing the opening 13, it is possible to visually check that the medium S, which is held in the medium holder 16, has run out.

(4) The operation of the recorder 31 is performed via the operating section 21, which is disposed on the exterior of the housing 12. On the other hand, the operation to dispose the medium S, which has been unrolled from the roll R, on the transport path, can be performed while disposing the opening/closing cover 17 in an open position, and visually checking the alarm unit 27. That is, by providing the alarm unit 27 at a position different from the operating section 21, it is possible to dispose the operating section 21 and the alarm unit 27 at the most easily visible positions in accordance with the nature of the operation.

(5) Since the opening/closing cover 17 has optical transparency, the display state of the alarm unit 27 (for example, whether or not the alarm light is lit) can be visually checked even when the opening/closing cover 17 is disposed in the closed position.

(6) When the detector 35 detects the leading edge of the medium S, the alarm unit 27 changes from an unlit state to a lit state, and thus, it is possible to more clearly indicate that the medium S has been correctly fed.

Moreover, the above-described embodiment may be modified as follows. Further, the modifications described below may be desirably combined.

The opening/closing cover 17 may be installed in a rotatable state with respect to the housing 12. For example, if a configuration is adopted in which a rotating shaft provided on the upper edge of the opening/closing cover 17 is rotatably supported by the upper edge of the opening 13, it is possible to implement a configuration in which the medium holder 16 can be pulled out from the housing 12 without removing the opening/closing cover 17 from the housing 12. Alternatively, it is possible to adopt a configuration in which the rotatable shaft of the opening/closing cover 17 is provided so as to extend in a vertical direction and the opening/closing cover 17 opens laterally.

The alarm unit 27 does not necessarily have to be disposed on the front plate 22 of the medium holder 16, and maybe disposed at a position where it is possible to visually check the alarm unit 27 simultaneously with the feed port 28. For example, it is also possible to dispose the alarm unit 27 in the feed port formation member 29 or the support walls 23. If the opening/closing cover 17 is configured to be rotatable, it is possible to provide the alarm unit 27 on the inner surface of the opening/closing cover 17.

A configuration may be adopted in which, without pulling out the medium holder 16 from the housing 12, the roll R is loaded in the medium holder 16. In this case, there is no need to provide the handle 26 in the medium holder 16.

It is possible to adopt a configuration in which, when the detector 35 detects the leading edge of the medium S, the alarm unit 27 changes from a lit state to an unlit state, and, when the detector 35 detects the trailing edge of the medium S, the alarm unit 27 changes from an unlit state to a lit state. According to this configuration, the alarm light is lit only when the medium S runs out, and therefore, it is possible to more strongly raise a warning about the fact that the medium S has run out, together with which it is possible to reduce the amount of electrical power consumed in lighting.

The alarm unit 27 is not limited to an alarm light, and may be a display that displays the presence or absence of the medium S by a symbol or by characters. Moreover, the display that displays the presence or absence of the medium S by a symbol or by characters may be provided in combination with an alarm light. Additionally, an alarm unit that generates sounds, or that can be felt, by vibrating, for example, may be provided.

It is possible to form part or all of the container formation member 18 from a transparent or a translucent material which transmits light, that is, a member having optical transparency. According to this configuration, even when the opening/closing cover 17 is disposed in a closed position and the container 19 covers the opening 13, light from the alarm unit 27 is transmitted through the container formation member 18, and visual checking of the light is possible. Accordingly, it is possible to visually check the alarm unit 27 more effectively. Hence, it is also possible to adopt a configuration in which, when the container 19 covers the opening 13, the alarm unit 27 does not emit light, and warnings are performed about the presence or absence of the medium S using symbols or characters. Moreover, in this case, even if a gap is not formed between the alarm unit 27 and the bottom of the container 19, it is possible to visually check whether the alarm unit 27 is lit, and the support protrusions 18*a* are not necessarily formed on the container formation member 18.

A configuration may be adopted in which the opening/closing cover 17 does not allow light to be transmitted. In this case also, for example, if recesses or slots are provided in the bottom of the container 19 that faces the alarm unit 27 when the container 19 is disposed in a closed position, it is possible to implement a configuration in which visual checking of the alarm unit 27 is possible even if the container 19 is disposed in the closed position.

If chips or the like due to the cutting with the cutter 37 are not generated, the container formation member 18 is not necessarily installed on the opening/closing cover 17, and the opening/closing cover 17 may serve as a cover that is not configured with the container 19.

A mechanical sensor provided with a lever that is displaced accompanying the passage of the medium S may be used for the detector 35.

The operating section 21 may be disposed on the top surface or side surface of the housing 12.

The medium S is not limited to printing paper, and may be a plastic film or thin board, or fabric used in textile printing.

The recording device is not limited to a printer that performs recording by ejecting a fluid such as ink, and for example, may be nonimpact printers such as laser printers, LED printers, thermal transfer printers (including dye sublimation printers), or may be impact printers such as dot impact printers.

The entire disclosure of Japanese Patent Application No. 2013-183800, filed Sep. 5, 2013 is expressly incorporated by reference herein.

What is claimed is:

1. A recording device, comprising:

a housing having an opening;

an opening/closing cover that is able to be disposed in a closed position where the opening is covered and an open position where the opening is exposed;

a medium holder that holds a medium;

a recorder that performs recording on the medium; and a transport mechanism that transports the medium along a transport path from the medium holder toward the recorder, wherein the medium holder is provided with a feed port, for the medium, connected to the transport path and an alarm unit warns that the medium is disposed at a position where the medium is able to be transported by the transport mechanism, wherein the alarm unit is disposed in a plate unit of the medium holder that defines the feed port which is situated at a position different from that of an operating section, and when the opening/closing cover is disposed in the open position, the feed port and the alarm unit are visually checked such that the alarm unit and feed port fall within the same field of view such that checking the warning status of the alarm unit and the feeding of the medium is performed within that view.

2. The recording device according to claim 1, wherein the opening/closing cover is detachable with respect to the housing, and the alarm unit issues a warning with the opening/closing cover removed from the housing.

3. The recording device according to claim 1, wherein the transport mechanism has a transport roller that transports the medium in the transport direction toward the recorder, a detector that detects the medium is provided on the transport path downstream of the transport roller in the transport direction, the alarm unit is an alarm light that is lit when the detector detects the medium, and when the opening/closing cover is in the closed position, it is possible to visually check the lit status of the alarm light.

4. The recording device according to claim 1, wherein the medium holder is retractable from the housing via the opening, and when the recorder performs recording, accommodated in the housing, and an operating section for operating the recorder is provided on the exterior of the housing.

5. The recording device according to claim 1, wherein the opening/closing cover has optical transparency.

* * * * *